US011396789B2

(12) United States Patent
Sehsah et al.

(10) Patent No.: US 11,396,789 B2
(45) Date of Patent: Jul. 26, 2022

(54) ISOLATING A WELLBORE WITH A WELLBORE ISOLATION SYSTEM

(71) Applicant: Saudi Arabian Oil Company, Dhahran (SA)

(72) Inventors: Ossama R. Sehsah, Dhahran (SA); Mahmoud Adnan Alqurashi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 45 days.

(21) Appl. No.: 16/940,574

(22) Filed: Jul. 28, 2020

(65) Prior Publication Data

US 2022/0034186 A1 Feb. 3, 2022

(51) Int. Cl.

| | |
|---|---|
| ***E21B 33/124*** | (2006.01) |
| ***E21B 47/06*** | (2012.01) |
| ***E21B 33/12*** | (2006.01) |
| ***E21B 47/12*** | (2012.01) |

(52) U.S. Cl.

CPC ..... *E21B 33/124* (2013.01); *E21B 33/1208* (2013.01); *E21B 47/06* (2013.01); *E21B 47/12* (2013.01)

(58) Field of Classification Search

CPC .... E21B 33/124; E21B 33/1208; E21B 47/06; E21B 47/12; E21B 33/03; E21B 33/02; E21B 33/00

See application file for complete search history.

(56) References Cited

U.S. PATENT DOCUMENTS

| | | | |
|---|---|---|---|
| 1,794,045 | A | 2/1931 | Lee |
| 1,812,044 | A | 6/1931 | Grant |
| 1,839,764 | A | 1/1932 | Kittredge et al. |

(Continued)

FOREIGN PATENT DOCUMENTS

| | | |
|---|---|---|
| AU | 2012231398 | 10/2017 |
| CA | 2985258 | 5/2018 |

(Continued)

OTHER PUBLICATIONS buyrov.com' [online], "Charpie: The best ROV manufacturer," available on or before 2017, retrieved on Jun. 27, 2019, retrieved from URL <www.buyrov.com/>, 5 pages.

(Continued)

*Primary Examiner* — Caroline N Butcher

(74) *Attorney, Agent, or Firm* — Fish & Richardson P.C.

(57) ABSTRACT

A system and a method for isolating pressure in a wellbore are described. The system includes a body, a first packer, a second packer, and a control assembly. The body couples to a wellhead and casing. The first packer is disposed within the body and fluidically seals the wellbore providing a first sealing boundary. The second packer is disposed within the body above the first packer to fluidically seal the first packer from the atmosphere providing a second sealing boundary. The first packer and the second packer are spatially arranged within the body to define a packer cavity. The control assembly senses a wellbore pressure on a bottom surface of the first packer, senses a packer cavity pressure, and compares the wellbore pressure to the packer cavity pressure to determine that the wellbore is fluidically sealed from the packer cavity.

17 Claims, 4 Drawing Sheets

(56) References Cited

U.S. PATENT DOCUMENTS 1,998,732 A 4/1935 Olds
2,110,913 A 3/1938 Lowrey
2,671,323 A 3/1951 Richert
2,690,897 A 10/1954 Clark
2,711,084 A 6/1955 Bergan
2,822,150 A 2/1958 Muse et al.
2,899,000 A 8/1959 Medders et al.
3,145,995 A 8/1964 Bliss et al.
3,220,478 A 11/1965 Kinzbach
3,253,336 A 5/1966 Brown
3,331,439 A 7/1967 Lawrence
3,335,801 A 8/1967 Wilsey
3,468,373 A 9/1969 Smith
3,557,875 A 1/1971 Solum et al.
3,839,791 A 10/1974 Feamster
3,854,032 A 12/1974 Cooper
3,918,411 A 11/1975 Wolowodiuk
4,058,163 A 11/1977 Yandell
4,287,957 A 9/1981 Evans
4,316,506 A 2/1982 Poole
4,357,520 A 11/1982 Taylor
4,384,625 A 5/1983 Roper et al.
4,384,730 A * 5/1983 Diehl ..... F16J 15/0881 277/322
4,399,873 A 8/1983 Lindsey, Jr.
4,407,136 A 10/1983 Kanter
4,458,761 A 7/1984 Van Vreeswyk
4,482,014 A 11/1984 Allwin et al.
4,621,186 A 11/1986 Taylor et al.
4,646,842 A 3/1987 Arnold et al.
4,674,569 A 6/1987 Revils et al.
4,681,159 A 7/1987 Allwin et al.
4,693,328 A 9/1987 Furse et al.
4,852,654 A 8/1989 Buckner
4,855,820 A 8/1989 Barbour
4,944,348 A 7/1990 Whiteley et al.
4,993,493 A 2/1991 Arnold
5,012,863 A 5/1991 Springer
5,018,580 A 5/1991 Skipper
5,070,952 A 12/1991 Neff
5,074,355 A 12/1991 Lennon
5,075,014 A 12/1991 Sullivan
5,152,342 A 10/1992 Rankin et al.
5,390,742 A 2/1995 Dines et al.
5,616,265 A 4/1997 Altman
5,947,213 A 9/1999 Angle
5,987,385 A 11/1999 Varsamis et al.
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,321,596 B1 11/2001 Newman
6,378,628 B1 4/2002 McGuire et al.
6,527,066 B1 3/2003 Rives
6,550,534 B2 4/2003 Brett
6,557,630 B2 5/2003 Harkins et al.
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,827,145 B2 12/2004 Fotland et al.
6,873,267 B1 3/2005 Tubel et al.
6,899,178 B2 5/2005 Tubel
6,938,698 B2 9/2005 Coronado
7,013,992 B2 3/2006 Tessari et al.
7,063,155 B2 6/2006 Ruttley
7,066,281 B2 6/2006 Grotendorst
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,806,173 B2 10/2010 Kaul et al.
7,823,663 B2 11/2010 Eddison
7,938,192 B2 5/2011 Rytlewski
7,940,302 B2 5/2011 Mehrotra et al.
7,967,066 B2 6/2011 McStay et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,936,009 B2 1/2015 Hu
8,991,489 B2 3/2015 Redlinger et al.
9,051,792 B2 6/2015 Herberg et al.
9,091,148 B2 7/2015 Moffitt et al.
9,121,255 B2 9/2015 Themig et al.
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,253,824 B2 2/2016 Inoue et al.
9,341,027 B2 5/2016 Radford et al.
9,353,589 B2 5/2016 Hekelaar
9,494,003 B1 11/2016 Carr
9,506,318 B1 11/2016 Brunet
9,546,536 B2 1/2017 Schultz et al.
9,611,697 B2 4/2017 Radford et al.
9,617,815 B2 4/2017 Schwartze et al.
10,113,408 B2 10/2018 Pobedinski et al.
10,302,083 B2 5/2019 Downton
10,544,640 B2 1/2020 Hekelaar et al.
2002/0053434 A1 5/2002 Chen et al.
2002/0070018 A1 6/2002 Buyaert
2002/0148607 A1 10/2002 Pabst
2003/0001753 A1 1/2003 Cernocky et al.
2003/0118230 A1 6/2003 Song
2004/0060741 A1 4/2004 Shipalesky et al.
2004/0069496 A1 4/2004 Hosie et al.
2004/0156264 A1 8/2004 Gardner et al.
2004/0173363 A1* 9/2004 Navarro-Sorroche ..... E21B 47/06 166/387
2005/0028980 A1 2/2005 Page et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261629 A1 11/2007 Choi
2007/0261855 A1 11/2007 Brunet
2008/0041631 A1 2/2008 Vail, III
2008/0115574 A1 5/2008 Meek
2008/0135494 A1 6/2008 Usher
2008/0223579 A1 9/2008 Goodwin
2009/0045974 A1 2/2009 Patel
2009/0050333 A1 2/2009 Smith
2009/0114448 A1 5/2009 Laird et al.
2009/0192731 A1 7/2009 De Jesus et al.
2009/0223670 A1 9/2009 Snider
2009/0289808 A1 11/2009 Prammer

(56) References Cited

U.S. PATENT DOCUMENTS

| | | | | |
|---|---|---|---|---|
| 2009/0301723 | A1 | 12/2009 | Gray | |
| 2010/0097205 | A1 | 4/2010 | Script | |
| 2010/0097450 | A1 | 4/2010 | Pugh | |
| 2010/0101786 | A1 | 4/2010 | Lovell et al. | |
| 2010/0212891 | A1 | 8/2010 | Stewart et al. | |
| 2010/0212900 | A1 | 8/2010 | Eddison et al. | |
| 2010/0212901 | A1 | 8/2010 | Buytaert | |
| 2010/0258297 | A1 | 10/2010 | Lyndre | |
| 2010/0258298 | A1 | 10/2010 | Lynde et al. | |
| 2010/0282511 | A1 | 11/2010 | Maranuk et al. | |
| 2011/0024195 | A1* | 2/2011 | Hoyer | E21B 19/00 175/65 |
| 2011/0036596 | A1 | 2/2011 | Nguyen et al. | |
| 2011/0067884 | A1 | 3/2011 | Burleson et al. | |
| 2011/0073329 | A1 | 3/2011 | Clemens et al. | |
| 2011/0100645 | A1 | 5/2011 | Yapici | |
| 2011/0127044 | A1 | 6/2011 | Radford et al. | |
| 2011/0147014 | A1 | 6/2011 | Chen et al. | |
| 2011/0240302 | A1 | 10/2011 | Coludrovich, III | |
| 2011/0266004 | A1 | 11/2011 | Hallundbaek et al. | |
| 2012/0048619 | A1 | 3/2012 | Seutter et al. | |
| 2012/0085531 | A1 | 4/2012 | Leising et al. | |
| 2012/0085540 | A1 | 4/2012 | Heijnen | |
| 2012/0152543 | A1 | 6/2012 | Davis | |
| 2012/0160512 | A1 | 6/2012 | Given et al. | |
| 2012/0175135 | A1 | 7/2012 | Dyer et al. | |
| 2012/0186817 | A1 | 7/2012 | Gibson et al. | |
| 2012/0211229 | A1 | 8/2012 | Fielder | |
| 2012/0241154 | A1 | 9/2012 | Zhou | |
| 2012/0247767 | A1 | 10/2012 | Themig et al. | |
| 2012/0307051 | A1 | 12/2012 | Welter | |
| 2012/0312560 | A1 | 12/2012 | Bahr et al. | |
| 2013/0128697 | A1 | 5/2013 | Contant | |
| 2013/0153245 | A1 | 6/2013 | Knobloch et al. | |
| 2013/0175055 | A1* | 7/2013 | Hart | E21B 33/03 166/387 |
| 2013/0186645 | A1 | 7/2013 | Hall | |
| 2013/0284434 | A1 | 10/2013 | Marvel | |
| 2013/0299160 | A1 | 11/2013 | Lott | |
| 2014/0060844 | A1 | 3/2014 | Barbour et al. | |
| 2014/0083769 | A1 | 3/2014 | Moriarty et al. | |
| 2014/0090898 | A1 | 4/2014 | Moriarty et al. | |
| 2014/0126330 | A1 | 5/2014 | Shampine et al. | |
| 2014/0131036 | A1 | 5/2014 | Huval et al. | |
| 2014/0139681 | A1 | 5/2014 | Jones, Jr. et al. | |
| 2014/0166367 | A1 | 6/2014 | Campbell et al. | |
| 2014/0172306 | A1 | 6/2014 | Brannigan | |
| 2014/0208847 | A1 | 7/2014 | Baranov | |
| 2014/0308203 | A1 | 10/2014 | Sheinberg et al. | |
| 2015/0027706 | A1 | 1/2015 | Symms | |
| 2015/0090459 | A1 | 4/2015 | Cain et al. | |
| 2015/0101863 | A1 | 4/2015 | Jeffryes | |
| 2015/0152713 | A1 | 6/2015 | Garcia et al. | |
| 2015/0176362 | A1 | 6/2015 | Prieto | |
| 2015/0267500 | A1 | 9/2015 | Van Dongen et al. | |
| 2015/0308203 | A1 | 10/2015 | Lewis | |
| 2015/0345254 | A1 | 12/2015 | Ciglenec et al. | |
| 2016/0160578 | A1 | 6/2016 | Lee | |
| 2016/0186519 | A1* | 6/2016 | Krejci | E21B 33/03 166/379 |
| 2016/0215612 | A1 | 7/2016 | Morrow | |
| 2016/0230508 | A1 | 8/2016 | Jensen | |
| 2016/0237764 | A1 | 8/2016 | Jellison et al. | |
| 2016/0237768 | A1 | 8/2016 | Jamison et al. | |
| 2016/0251931 | A1 | 9/2016 | Buchan et al. | |
| 2016/0312565 | A1 | 10/2016 | Papadimitriou | |
| 2016/0356152 | A1 | 12/2016 | Croux | |
| 2017/0067318 | A1 | 3/2017 | Haugland | |
| 2017/0074071 | A1 | 3/2017 | Tzallas et al. | |
| 2018/0030810 | A1 | 2/2018 | Saldanha | |
| 2018/0171774 | A1 | 6/2018 | Ringer et al. | |
| 2019/0030673 | A1 | 1/2019 | Pereira | |

FOREIGN PATENT DOCUMENTS

| | | |
|---|---|---|
| CN | 102322415 | 1/2012 |
| CN | 202300959 | 7/2012 |
| CN | 204177988 | 2/2015 |
| CN | 104405304 | 3/2015 |
| DE | 102005026534 | 12/2006 |
| EP | 0377234 | 10/1989 |
| EP | 0618345 | 10/1994 |
| EP | 1241321 | 9/2002 |
| EP | 2157278 | 2/2010 |
| EP | 2692982 | 5/2014 |
| EP | 2835493 | 2/2015 |
| GB | 2157743 | 10/1985 |
| GB | 2261238 | 12/1993 |
| GB | 2460096 | 11/2009 |
| GB | 2470762 | 12/2010 |
| WO | WO 1995035429 | 12/1995 |
| WO | WO 2003058545 | 7/2003 |
| WO | WO 2004042185 | 5/2004 |
| WO | WO 2007049026 | 5/2007 |
| WO | WO 2007070305 | 6/2007 |
| WO | WO 2011038170 | 3/2011 |
| WO | WO 2011095600 | 8/2011 |
| WO | WO 2011159890 | 12/2011 |
| WO | WO 2016144345 | 9/2016 |
| WO | WO 2019147827 | 8/2019 |

OTHER PUBLICATIONS

Engineering Innovation Worldwide, TIW XPAK Liner Hanger System brochure, 2015 TIW Corporation, Houston TX , TIW0001D Jun. 2015, retrieved from the internet at: http://www.tiwoiltools.com/Images/Interior/downloads/tiw_xpak_brochure.pdf, 4 pages.

Engineers Edge—ACME Stuf Threads Size Designation Table Chart, retrieved from the internet at: http://www.engineersedge.com/hardware/acme-stub-thread.htm, retrieved Feb. 27, 2017, 2 pages.

exploration.marinersmuseum.org' [online], "ROV", available on or before May 2019, retrieved on Jun. 27, 2019, retrieved from URL <https://exploration.marinersmuseum.org/object/rov/, 3 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.

Phys.org', [online], "Team develops underwater robot to assist in oil-spill cleanup," Phys Org, Mar. 16, 2015, 3 pages.

rigzone.com', [online], "How Do ROVs Work?"available on or before 1999, retrieved on Jun. 27, 2019, retrieved from URL <https://www.rigzone.com/training/insight.asp?insight_id=343&c_id=>, 5 pages.

PCT International Search Report and Written Opinion in International Appln. No. PCT/US2021/043521, dated Oct. 21, 2021, 15 pages.

* cited by examiner

ISOLATING A WELLBORE WITH A WELLBORE ISOLATION SYSTEM

TECHNICAL FIELD

This disclosure relates to sealing pressurized fluid and gas in a wellbore.

BACKGROUND

Wellbores in an oil and gas well are filled with both liquid and gaseous phases of various fluids and chemicals including water, oils, and hydrocarbon gases. The fluids and gasses in the wellbore can be pressurized. A wellhead is installed on the wellbore to seal the wellbore and to control the flow of oil and gas from the wellbore. The wellhead can include multiple components including isolation valves, blowout preventers, chokes, and spools. The wellhead is mechanically coupled to a wellbore casing disposed in the wellbore. Maintenance tasks may be performed on the components of the wellhead. The components of the wellhead may require removal to perform the preventative or corrective maintenance tasks. The wellbore may need to be isolated during the performance of the wellhead maintenance.

SUMMARY

This disclosure describes technologies related to isolating a wellbore with a wellbore isolation system. Implementations of the present disclosure include a wellbore pressure isolation system. The wellbore pressure isolation system includes a body, a first packer, a second packer, and a control assembly. The body couples to a wellbore casing assembly at a wellhead. The first packer is coupled to the body. The first packer is configured to be disposed inside the wellhead. The first packer fluidically seals the wellbore providing a first sealing boundary. The first sealing boundary prevents a pressurized fluid from crossing from a first side of the first sealing boundary to a second side of the first sealing boundary. The second packer is coupled to the body. The second packer is configured to be disposed in the wellhead at an uphole location relative to the first packer. The second packer fluidically seals the first packer from an atmosphere of the Earth providing a second sealing boundary. The second sealing boundary prevents a second pressurized fluid from crossing from a first side of the second sealing boundary to a second side of the second sealing boundary. The first packer and the second packer are spatially arranged within the body to define a packer cavity. The control assembly is coupled to the body, the first packer, and the second packer. The control assembly senses a wellbore pressure on a bottom surface of the first packer, senses a second pressure in the packer cavity, and compares the wellbore pressure to the second pressure to determine that the wellbore is fluidically sealed from the packer cavity.

In some implementations, the body further includes an upper section, a middle section, and a lower section. The upper section is configured to accept a blowout preventer assembly. The middle section is coupled to the upper section. The middle section is configured to accommodate the first packer and the second packer. The first packer is positioned below the second packer. Below the second packer is toward the wellbore. The lower section is coupled to the middle section. The lower section is configured to couple to a wellbore casing at a surface of the Earth.

In some implementations, the first packer and the second packer are configured to receive a locking device from the middle section of the body. The locking device is configured to secure the first packer and the second packer to the body.

In some implementations, the locking device is multiple lockdown screws.

In some implementations, the wellbore pressure isolation system further includes a packer spacer housing configured to mechanically couple the first packer to the second packer. The second packer is offset from the first packer.

In some implementations, the control assembly further includes a controller, a first pressure sensor, and a second pressure sensor. The first pressure sensor is configured to sense the wellbore pressure on the bottom surface of the first packer and transmit signals representing the wellbore pressure to the controller. The second pressure sensor is configured to sense the second pressure in the packer cavity and transmit signals representing the second pressure to the controller. The controller compares the wellbore pressure to the second pressure to determine that the wellbore is fluidically sealed from the packer cavity.

In some implementations, the middle section further includes a first location sensor and a second location sensor. The first location sensor is disposed within the body and coupled to the first packer. The first location sensor is configured to sense the first packer location. The second location sensor is disposed within the body and coupled to the second packer. The second location sensor is configured to sense the second packer location. The first location sensor and the second location sensor are configured to sense the first packer location and the second packer location and transmit signals representing the sensed first packer location and the second packer location to the control assembly. The control assembly receives the signal representing the sensed first packer location and the signal representing the sensed second packer location to determine that the first packer and the second packer are placed to fluidically seal the wellbore from the packer cavity.

In some implementations, the first packer and the second packer are coupled to a drill string and configured to isolate the wellbore during drilling operations.

In some implementations, the first packer and the second packer are disposed in the wellbore with a J-slot running tool configured to couple with the first packer and the second packer to place the first packer and the second packer in the body.

Further implementations of the present disclosure include a wellhead sealing assembly. The wellhead sealing assembly includes a first packer, a second packer, a packer spacer housing, and a control assembly. The first packer is configured to be disposed in a wellhead. The first packer fluidically seals a wellbore providing a first sealing boundary. The first sealing boundary is configured to prevent a pressurized fluid from crossing from a first side of the first sealing boundary to a second side of the first sealing boundary. The second packer is configured to be disposed in a wellhead. The second packer fluidically seals the first packer from an atmosphere of the Earth providing a second sealing boundary. The second sealing boundary is configured to prevent a second pressurized fluid from crossing from a first side of the second sealing boundary to a second side of the second sealing boundary. The packer spacer housing is configured to mechanically couple the first packer to the second packer. The second packer is offset from the first packer. The control assembly is coupled to the first packer and the second packer. The control assembly is configured to sense a wellbore pressure on a bottom surface of the first packer, sense a second pressure in a packer cavity defined by the first packer, the second packer, the packer spacer housing, and the wellhead, and compare the wellbore pressure to the second pressure to determine that the wellbore is fluidically sealed from the packer cavity.

In some implementations, the wellhead sealing assembly further includes a first pressure sensor and a second pressure sensor. The first pressure sensor is disposed in the first packer. The first pressure sensor is configured to sense a first pressure on a bottom surface of the first packer and transmit signals representing the first pressure to the control assembly. The bottom surface of the first packer is a wellbore pressure. The second pressure sensor is disposed in the second packer. The second pressure sensor is configured to sense a second pressure in a packer cavity defined by a top surface of the first packer, a bottom surface of the second packer, the packer spacer housing, and the wellhead, and transmit signals representing the second pressure to the control assembly.

In some implementations, the control assembly further includes a controller. The controller is configured to receive signals representing the first pressure, receive signals representing the second pressure, and compare the first pressure to the second pressure to determine that the wellbore is fluidically sealed from the packer cavity.

In some implementations, the controller is further configured to receive a signal from a first location sensor disposed in the first packer. The first location sensor is configured to sense the first packer location. The controller is further configured to receive a signal from a second location sensor disposed in the second packer. The second location sensor is configured to sense the second packer location. The controller is further configured to determine that the first packer and the second packer are placed to fluidically seal the wellbore from the packer cavity.

In some implementations, the first packer and the second packer are configured to receive a locking device from the wellhead, wherein the locking device is configured to secure the first packer and the second packer to the wellhead.

Further implementations of the present disclosure include a method for isolating a wellbore pressure at the wellhead. The method includes sensing a wellbore pressure on a bottom surface of a first packer. The first packer is disposed in a wellhead and configured to provide a first sealing boundary to seal the wellbore. The first sealing boundary is configured to prevent a pressurized fluid from crossing from a first side of the first sealing boundary to a second side of the first sealing boundary. The method includes transmitting a signal representing the wellbore pressure to a controller. The method includes sensing a second pressure in a packer cavity. The packer cavity is defined by a top surface of the first packer, a bottom surface of a second packer disposed in the wellhead and configured provide a second sealing boundary to seal the wellhead. The second sealing boundary is configured to prevent a second pressurized fluid from crossing from a first side of the second sealing boundary to a second side of the second sealing boundary. The method includes transmitting a signal representing the second pressure to the controller. The method includes comparing the wellbore pressure to the second pressure. The method includes determining that the wellbore is fluidically sealed from the packer cavity.

In some implementations, the method further includes sensing a third pressure on a top surface of the second packer, transmitting a signal representing the third pressure to the controller, comparing the second pressure to the third pressure, and determining that the packer cavity is fluidically sealed from the top surface of the second packer.

In some implementations, the third pressure is an atmospheric pressure of the Earth.

In some implementations, the wellbore is sealed from packer cavity when the second pressure is less than the wellbore pressure.

In some implementations, the wellbore is sealed from the packer cavity when a difference between the wellbore pressure and the second pressure is greater than or equal to a target pressure difference.

In some implementations, the method further includes monitoring the wellbore pressure and the second pressure for a time period and determining that the wellbore is fluidically sealed from the packer cavity when the difference between the wellbore pressure and the second pressure is greater than or equal to the target pressure difference for the time period.

In some implementations, the method further includes sensing a first packer seated condition. The first packer seated condition occurs when the first packer is engaged in a first location configured to seal the wellbore. The method further includes transmitting a signal representing the first packer seated condition to the controller. The method further includes sensing a second packer seated condition. The second packer seated condition occurs when the second packer is engaged to a second location configured to seal the first packer from an atmosphere of the Earth. The method further includes transmitting a signal representing the second packer seated condition to the controller. The method further includes determining that the first packer and the second packer are positioned to fluidically seal the wellbore when the first packer seated condition and the second packer seated condition is received by the controller.

In some implementations, the method further includes, responsive to determining that the first packer and the second packer are positioned to fluidically seal the wellbore by the first packer seated condition and the second packer seated condition, sensing a first packer locked condition. The first packer locked condition occurs when the first packer is locked in the first location by a lockdown device. The method further includes transmitting a signal representing the first packer locked condition to the controller. The method further includes sensing a second packer locked condition. The second packer locked condition occurs when the second packer is locked in the second location by a lockdown device. The method further includes transmitting a signal representing the second packer locked condition to the controller. The method further includes determining that the first packer is locked in the first location and the second packer is locked in the second location to fluidically seal the wellbore when the first packer locked condition and the second packer locked condition is received by the controller.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes a system and a method for isolating a wellbore with a wellbore pressure isolation system. The wellbore in an oil and gas well is filled with both pressurized liquid and gaseous phases of various fluids including water, oils, and hydrocarbon gases. A wellhead is installed on the surface of the Earth and coupled to the wellbore to seal the wellbore and to control the flow of oil and gas from the wellbore. The wellhead is mechanically coupled to a wellbore casing disposed in the wellbore. The wellhead can include multiple components to seal and control the wellbore fluids and gasses including isolation valves, blowout preventers, chokes, and spools. Maintenance tasks may be performed on the components of the wellhead. The maintenance tasks can be preventative or corrective. The components of the wellhead may require removal to perform the preventative or corrective maintenance tasks. Some of the components, when removed, will prevent the wellhead from isolating the wellbore. In some cases, uncontrolled formation pressure surges or fluid flows can travel through the wellbore to the surface of the Earth. This can cause severe environmental damage and endanger personnel. The wellbore may need to be isolated during the performance of the wellhead maintenance to prevent these detrimental effects.

Implementations of the present disclosure realize one or more of the following advantages. Preventative and corrective maintenance on wellhead components can be conducted. For example, a blowout preventer or wellhead isolation valve can be removed and replaced. Additionally, environmental safety is improved. For example, pressure boundaries are provided to prevent the uncontrolled release of wellbore fluids and gases into the area surrounding a wellbore. The surrounding area could be the surface of the Earth if the wellhead is installed on land or the ocean if the wellhead is a subsea wellhead. Also, personnel safety is improved. Additional pressure boundaries are can be used during wellbore operations. Ease of compliance with regulatory restrictions is improved as wellhead maintenance can be more safely conducted with additional barriers.

Figure 1:
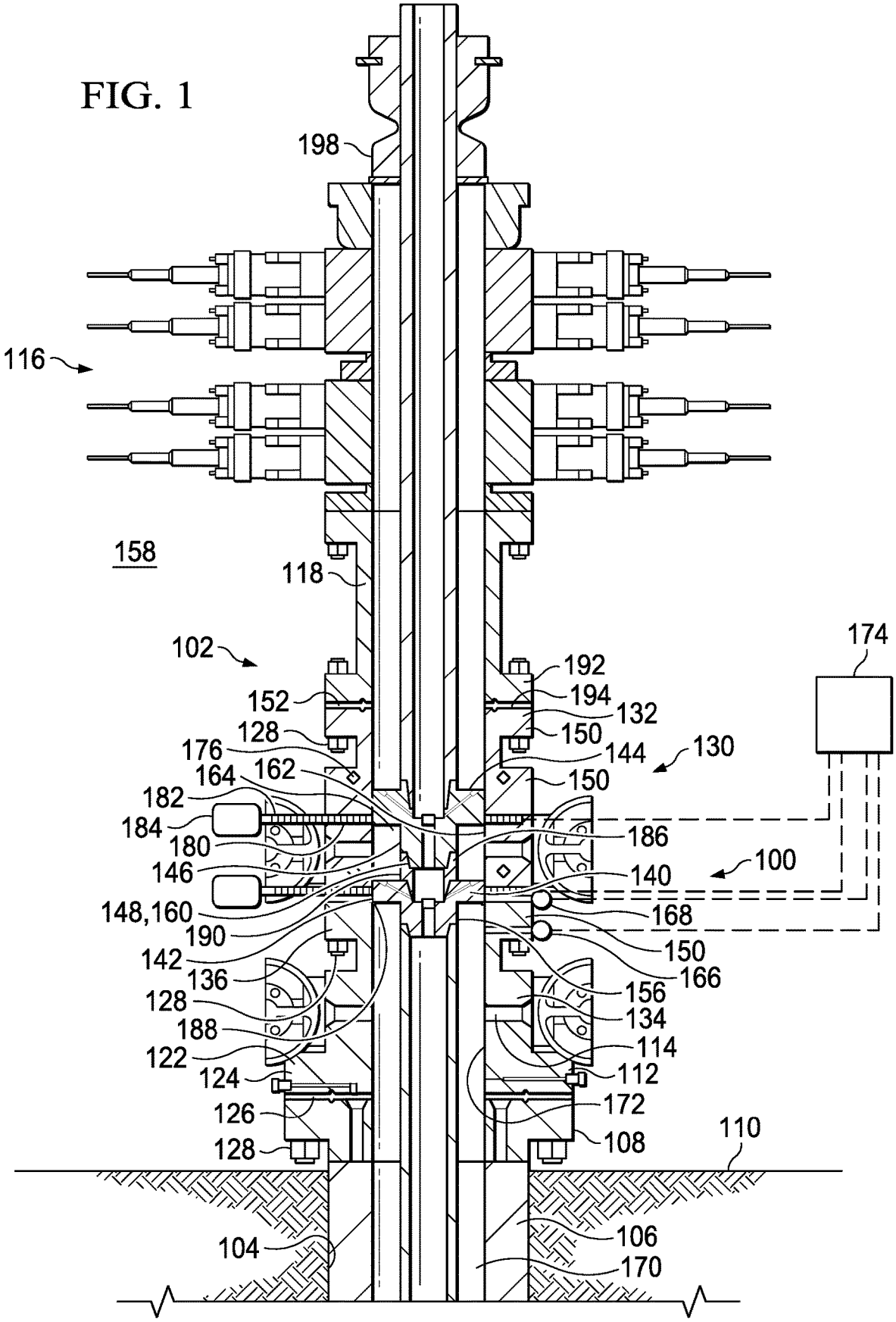
FIG. 1 is a schematic view of a wellhead pressure isolation system installed on a wellbore.

FIG. 1 shows a wellbore pressure isolation system 100 installed in a wellhead 102. The wellhead 102 is coupled to a wellbore 104. The wellhead 102 seals the wellbore 104 providing a pressure boundary to the environment preventing wellbore 104 fluids from leaking onto the surface 110 of the Earth. The wellbore 104 extends from a surface 110 of the Earth. The wellbore 104 includes a casing 106 with a flange 108. The flange 108 is flush with or above the surface 110 of the Earth. The wellbore pressure isolation system 100 is mechanically coupled to the casing 106 flange 108. For example, the wellhead 102 can be mechanically coupled by fastening devices 128. For example, fastening devices 128 can be bolts and nuts or studs and nuts.

The wellhead 102 can include a spool 112. The spool 112 has a body 122 with flanges 124 coupled to both ends of the body. The body 122 is a cylindrical hollow body. The flanges 124 have voids 126 configured to accommodate fastening devices 128. The body 122 can include one or more outlets 114. The spool 112 couples the casing 106 to the wellhead 102. The spool 112 can be used to couple a tubing hanger to the wellhead 102. The spool 112 is mechanically coupled to the casing 106 or tubing hanger. For example, the spool 112 can be welded or engaged with a slip and seal assembly to the casing 106 or tubing hanger. The spool 112 is mechanically coupled to other components in the wellhead by fastening devices 128 disposed in the voids 126 of the flanges 124. The spool 112 can be mechanically coupled to another spool 112 or a blowout preventer 116. For example, the spool 112 can be fastened to another spool with fastening devices 128 such as bolts and nuts or studs and nuts. The outlet 114 can connect the hollow cylinder body 122 to a valve 116. The valve 116 can open and close to allow wellbore fluid to flow through the outlet 114. The valve 116 can be connected to a choke and kill conduit to control well pressure excursions. Alternatively, the valve 116 can be connected to drilling mud system during drilling operations.

The spool 112 can be constructed from a metal such as steel or an alloy. The spool 112 has a nominal outer diameter that can be between 6 inches and 20 inches. The dimensions and material properties of the spool 112 can conform to an American Petroleum Institute (API) standard or a proprietary specification.

The wellhead 102 can include a blowout preventer 116 configured to rapidly seal the wellhead 102 in an emergency such as a blowout. A blowout is an uncontrolled release of wellbore fluids and gases. The wellhead 102 can include multiple blowout preventers 116. A blowout preventer 116 can be an annular blowout preventer **116*a* or a ram blowout preventer 116*b***.

The annual blowout preventer **116*a* seals around a tubular 118 disposed in the wellhead 102. The ram blowout preventer 116*b* can shear the tubular 118 disposed in the wellhead 102. A blowout preventer 116 can require preventative or corrective maintenance tasks. The maintenance tasks can require blowout preventer 116 removal. With the blowout preventer 116 removed or unable to operatively seal the wellbore, no means of preventing a blowout is provided by the wellhead 102**.

The wellhead 102 includes the wellbore pressure isolation system 100 mechanically coupled between the spool 112 and the blowout preventer 116. The wellbore pressure isolation system 100 includes a body 130. The body 130 includes an upper section 132, coupled to a middle section 134, and a lower section 136 coupled to the middle section 134. The body 130 is a single, unitary body with three sections. Alternatively, the body 130 can have three separate sections coupled to each other.

The upper section 132 is configured to accept the blowout preventer 116. The upper section 132 is a cylindrical hollow body. The upper section 132 has flanges 138 coupled to both ends of the upper section 132. The flanges 138 have voids 126 configured to accommodate fastening devices 128. The blowout preventer 116 has a corresponding flange 192 and voids 194 configured to accommodate fastening devices 128. The fastening devices 128 pass through the voids 126 and the voids 194 to secure the upper section 132 flanges 138 to the blowout preventer 116 flanges. The upper section 132 can include a pressure sensor configured to sense atmospheric pressure. The upper section 132 can be constructed from a metal. For example, the upper section 132 can be constructed from steel or an alloy.

The middle section 134 is mechanically coupled to the upper section 132 and the lower section 136. The middle section 134 is a hollow body with an inner surface 162. The middle section 134 has flanges 150 coupled to both ends of the hollow body. The flanges 150 have voids 152 configured to accommodate fastening devices 128 to couple to the middle section 134 to the upper section 132 and the lower section 136. For example, the fastening devices 128 can be bolts with nuts or studs with nuts. The middle section 134 can be constructed from a metal. For example, the middle section 134 can be constructed from steel or an alloy.

The middle section 134 is configured to accommodate a first packer 140 in a first location 142 and a second packer 144 at a second location 146. The first packer 140 is positioned below the second packer 144. Below the second packer 144 is toward the wellbore 104. The first packer 140 is configured to fluidically seal the wellbore 104 providing a first sealing boundary defined by the bottom surface 154 of the first packer 140 and the casing inner surface 156. The second packer 144 is configured to fluidically seal the first packer 140 from an atmosphere 158 of the Earth providing a second sealing boundary defined by the bottom 160 of the second packer 144 and the middle body 134 inner surface 162. The sealing boundary prevents a pressurized fluid from crossing from one side of the sealing boundary to another side of the sealing boundary. The sealing boundary does not appreciably deflect when pressurized from one side or both sides. A pressure cavity 164 is defined by the bottom surface 160 of the second packer 144, the middle section 134 inner surface, and a top surface 162 of the first packer 140. The pressure cavity 164 is bounded by the first sealing boundary and the second sealing boundary. The pressure cavity 164 isolates the wellbore 104 from the atmosphere 158. The pressure cavity 164 allows for the monitoring of the first sealing boundary and the second sealing boundary integrity.

The middle section 134 has an inner profile 148. The inner profile 148 is key-like shaped to allow the first packer 140 to pass through the second location 142 and seat at the first location 142. The inner profile 148 is key-like shaped to seat the second packer 144 at the second location 142.

The middle section 134 can include multiple ports 180 configured to accept lockdown devices 182. The threaded ports 180 are situated about the first packer 140 and second packer 144 to allow the lockdown devices 182 mechanically couple to the first packer 140 and second packer 144. The lockdown devices 182 secure the first packer 140 at the first location 142 and second packer 144 at the second location 146. The lockdown devices 182 can be lockdown screws. The threaded ports 180 can be threaded to accept the lockdown screws. The wellhead 102 can include a hydraulic control system 184 to operate the lockdown screws. Operating the lockdown screws includes rotating the lockdown screws to engage to or disengage from the first packer 140 and the second packer 144. Alternatively, the lockdown device can be movable rings.

The middle section 134 hollow body is configured to accept multiple sensors. The sensors include a first pressure sensor 166 and a second pressure sensor 168. The first pressure sensor 166 is senses the wellbore pressure. The wellbore pressure is sensed in cavity 170 defined by the bottom 154 of the first packer 140, the lower body inner surface 172, and the casing inner surface 156. The first pressure sensor 166 transmit signals representing the wellbore pressure to a controller 174. The second pressure sensor 168 senses a second pressure in the packer cavity 164 and transmit signals representing the second pressure to the control assembly 174. The middle section can include an atmospheric pressure sensor configured to sense atmospheric pressure 158 and transmit signals representing the atmospheric pressure to the controller.

The sensors can include a first location sensor 176 and a second location sensor 178. The first location sensor 176 and a second location sensor 178 can be a position switch or a proximity sensor. Alternatively, Radio Frequency Identification (RFID) tags can be placed in the first packer 140 and the second packer 144. The first location sensor 176 and a second location sensor 178 confirm that the first packer 140 and the second packer 144 have landed at the first location 142 and the second location 146 that is required to assure seal integrity and proper activation to lock the first packer 140 and the second packer 144 in place. The first location sensor 176 and the second location sensor 178 can be a RFID tag reader. The first location sensor 176 is disposed within the middle section 134 at the first location 142 to sense the first packer 140 when the first packer 140 is seated at the first location 142. The first location sensor 176 can be coupled to the first packer 140. The second location sensor 178 is disposed within the middle section 134 at the second location 146 to sense the second packer 144 when the second packer 144 is seated at the second location 146. The second location sensor 178 can be coupled to the second packer 146. The first location sensor 176 and the second location sensor 178 transmit signals representing the sensed first packer location and the second packer location to the control assembly 174.

The control assembly 174 is coupled to the sensors disposed in the middle section 134. The control assembly 174 receives the signal representing the sensed wellbore cavity 170 pressure from the first pressure sensor 166 and the signal representing the sensed packer cavity 164 pressure from the second pressure sensor 168. The control assembly 174 compares the wellbore cavity 170 pressure to the packer cavity 164 pressure to determine whether the first packer 140 and the second packer 144 are fluidically sealing the wellbore cavity 170 from the packer cavity 164. The control assembly 174 receives the signal representing the atmospheric 158 pressure. The control assembly 174 compares the packer cavity 164 pressure to the atmosphere 158 pressure to determine whether the second packer 144 is fluidically sealing the packer cavity 164 from the atmosphere 158. Also, the control assembly 174 receives the signal representing the sensed first packer 140 location when the first packer 140 is seated at the first location 142 and the signal representing the sensed second packer 144 location when the second packer 144 is seated at the second location 146 to determine whether the first packer 140 and the second packer 144 are placed in the correct locations to fluidically seal the wellbore cavity 170 from the packer cavity 164 and the packer cavity 164 from the atmosphere 158. When the first packer 140 and the second packer 144 are fluidically sealing the wellbore cavity 170, the wellhead 102 components, for example a blowout preventer 116, can be removed from the wellhead 102 to perform maintenance. When the first packer 140 and the second packer 144 are not fluidically sealing the wellbore cavity 170, maintenance cannot safely be performed on the wellhead 102 components.

The control assembly 174 can include a controller. The controller can be a non-transitory computer-readable medium storing instructions executable by one or more processors to perform operations described here. The controller 174 can include firmware, software, hardware or combinations of them. The instructions, when executed by the one or more computer processors, cause the one or more computer processors to compare the wellbore cavity 170 pressure to the packer cavity 164 pressure to determine that the first packer 140 and the second packer 144 are fluidically sealing the wellbore cavity 170 from the packer cavity 164 and the packer cavity 164 from the atmosphere 158. Also, the one or more computer processors determine when the first packer 140 is seated at the first location 142 and when the second packer 144 is seated at the second location 146 to determine that the first packer 140 and the second packer 144 are placed in the correct locations to fluidically seal the wellbore cavity 170 from the packer cavity 164.

The lower section 136 is coupled to the middle section, the lower section configured to couple to a wellbore casing at a surface of the Earth. The lower section can be a spool 112. The lower section 136 is configured to accept the casing 106 flange 108 or the spool 112. The lower section 136 is also configured to couple to the middle section 134. The lower section 136 is a cylindrical hollow body. The lower section 136 has flanges 138 coupled to both ends of the upper section 132. The flanges 138 have voids 126 configured to accommodate fastening devices 128. The lower section 136 can be constructed from a metal. For example, the lower section 136 can be constructed from steel or an alloy.

The first packer 140 and the second packer 144 are configured to seat in the first location 142 and the second location 146, respectively. The first packer 140 has an outer profile 176 corresponding to the first location 142 inner profile 148 of the middle section 134. The first packer 140 fluidically seals wellbore 104 in the middle section 134 providing the first pressure boundary for the wellbore 104. The second packer 144 has an outer profile 178 corresponding to the second location 146 of the inner profile 148 of the middle section 134. The second packer 144 fluidically seals the first packer 140 from the atmosphere 158. The top surface 196 of the second packer 144 can be exposed to the atmosphere 158 when the wellhead 102 components, for example the blowout preventer 116 is removed. The inner profile 148 is key-shaped to allow the first packer 140 to pass through the second location 142 and seat at the first location 142. For example, the first location 142 inner profile 148 can have a 1/16" smaller diameter than the second location 146 inner profile 148. The first packer 140 can have a 1/16" smaller diameter, corresponding to the first location 142 inner profile 148 diameter. The first packer 140 can pass through the second location 146, but seats at the first location 142. The second packer 144 has a 1/16" larger diameter than the first packer 140 seats at the second location 146. The first packer 140 and the second packer 144 can each have an o-ring rubber seal 188 around their circumference providing a sealing surface the inner profile 148.

The first packer 140 and the second packer 144 are a typical oil and gas industry rubber elastomer element (the packer) that is designed based on requirement to a pressure rating based on wellbore conditions and regulatory requirements. Different packers can be rated for different pressures. For example, packers can be rated to 1000 psi, 3000 psi, 5000 psi, 10,000 psi, or 24,000 psi. A mechanical connector 190 mechanically couples the first packer 140 to the second packer 144. The mechanical connector 190 can be a standard API rotary shoulder pin connector. For example, the standard API rotary-shouldered connector can be a regular connection, a numeric connection, an internal flush connection, or a full-hole connection. For example, the pin connection can be a manufacturer proprietary design. Alternatively, the mechanical connector 190 can be a box connection, where the threads are internal to the box. The mechanical connector 190 can have an outer diameter corresponding to a standard API connection size. For example, the mechanical connector 190 can have an outer diameter of 4½ inches, 5½ inches, 6⅝ inches, 7 inches, 7⅝ inches, 8⅝ inches, 9⅝ inches, 10¾ inches, 11¾ inches, or 13⅜ inches.

The first packer 140 and the second packer 144 are configured to accept multiple lockdown devices 182. The lockdown devices 182 secure the first packer 140 at the first location 142 and the second packer 144 at the second location 146 in the middle section 134.

The second packer can be offset from the first packer by a packer spacer housing 186. The packer spacer housing 186 is a cylindrical body. The packer spacer housing 186 can be hollow. The packer spacer housing is mechanically coupled to the first packer 140 and the second packer 144. For example, the packer spacer housing can be welded or fastened to the first packer 140 and the second packer 144.

Figure 2:
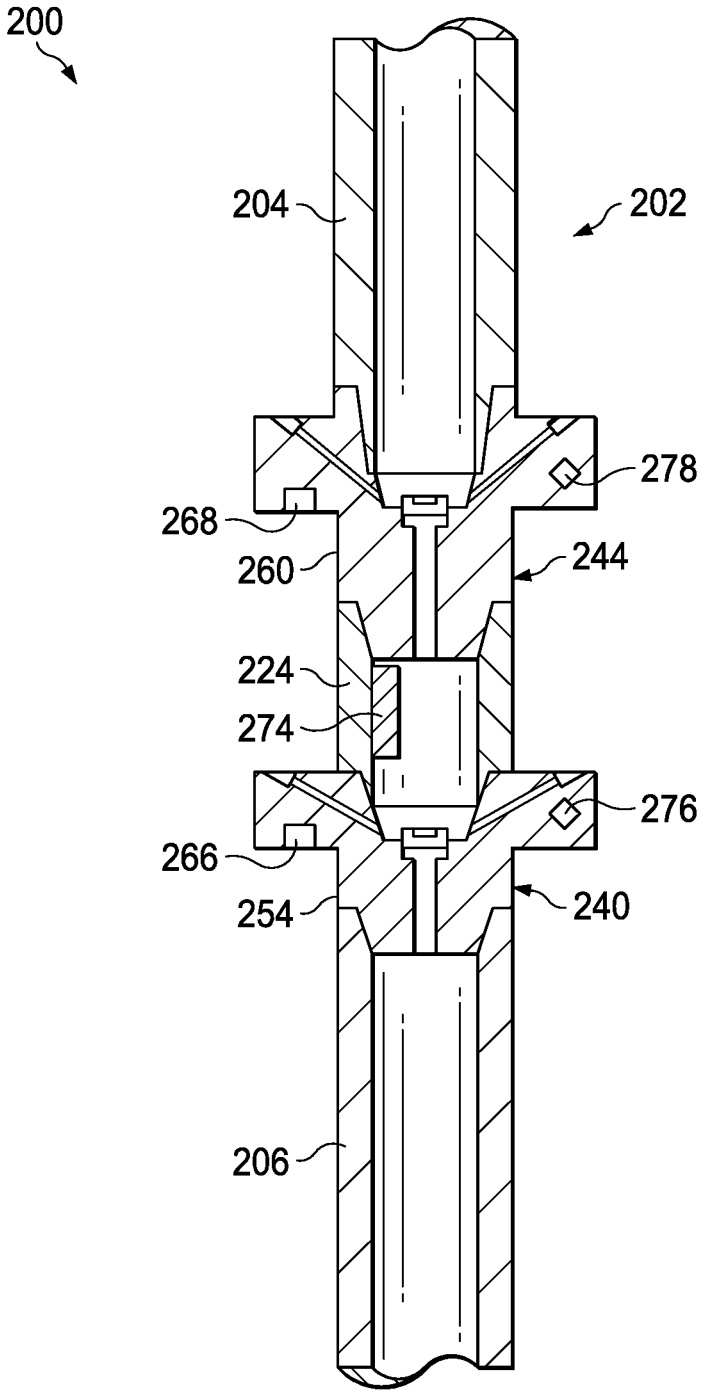
FIG. 2 is a schematic view of wellhead pressure isolation system of FIG. 1 installed on a drill pipe.

Referring to FIG. 2, a wellhead sealing assembly 200 can isolate the wellbore 104 at the wellhead 102 during drilling operations. A first packer 240 and a second packer 244 are coupled to a drill string 202 to isolate the wellbore 104 at the wellhead 102 during drilling operations. The drill string 200 can include an upper drill pipe 204 and a lower drill pipe 206. The upper drill pipe's 204 and the lower drill pipe's 206 dimensions and material properties can conform to an API standard or a proprietary specification. For example, the drill pipe can have an outer diameter of 4½ inches, 5½ inches, 6⅝ inches, 7 inches, 7⅝ inches, 8⅝ inches, 9⅝ inches, 10¾ inches, 11¾ inches, or 13⅜ inches. The second packer can be offset from the first packer by a packer spacer housing 286. The control assembly 274 is disposed in the packer spacer housing 286. The control assembly 274 is substantially similar to the control assembly described earlier.

The first packer 240 and the second packer 244 are substantially similar to the first packer 140 and the second packer 140 discussed earlier, with the below exceptions. The first pressure sensor 266 is disposed in the first packer 240. The first pressure sensor 266 senses the wellbore pressure on the bottom surface 254 of the first packer 240 when the wellhead sealing assembly 200 is disposed in the wellhead 102. The second pressure sensor 268 is disposed in the second packer 244. The second pressure sensor 268 senses the packer cavity pressure on the bottom surface 260 of the second packer 240 when the wellhead sealing assembly 200 is disposed in the wellhead 102. The first pressure sensor 266 transmits signals representing the wellbore pressure to a controller 274. The second pressure sensor 168 senses a second pressure in the packer cavity 264 and transmit signals representing the second pressure to the control assembly 274. The first location sensor 276 is disposed within the first packer 240 to sense that the first packer 240 is seated in the wellhead 102. The second location sensor 278 is disposed within the second packer 244 to sense that the second packer 244 is seated in the wellhead 102. The first location sensor 276 and the second location sensor 278 transmit signals representing the sensed first packer location and the second packer location to the control assembly 274.

Figure 3A:
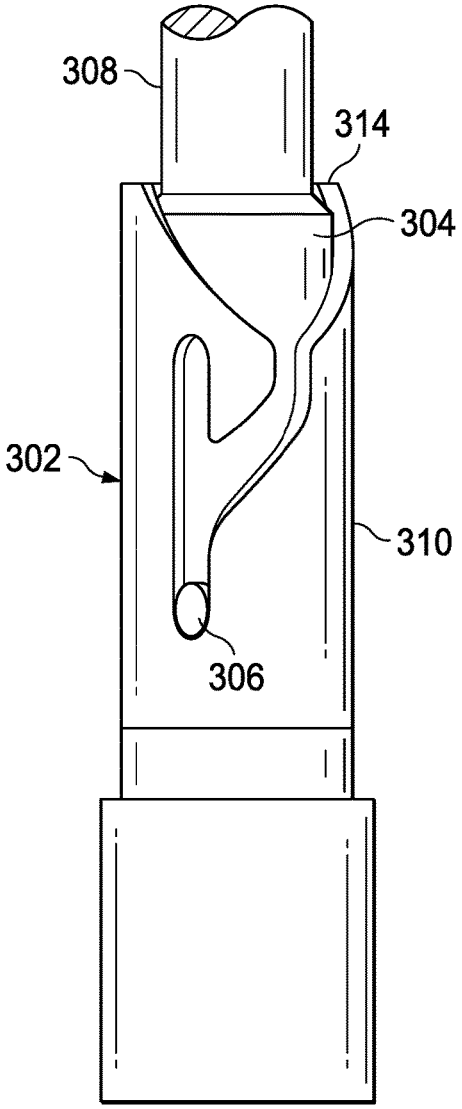
FIG. 3A is a schematic view of a J-slot running tool.
Figure 3B:
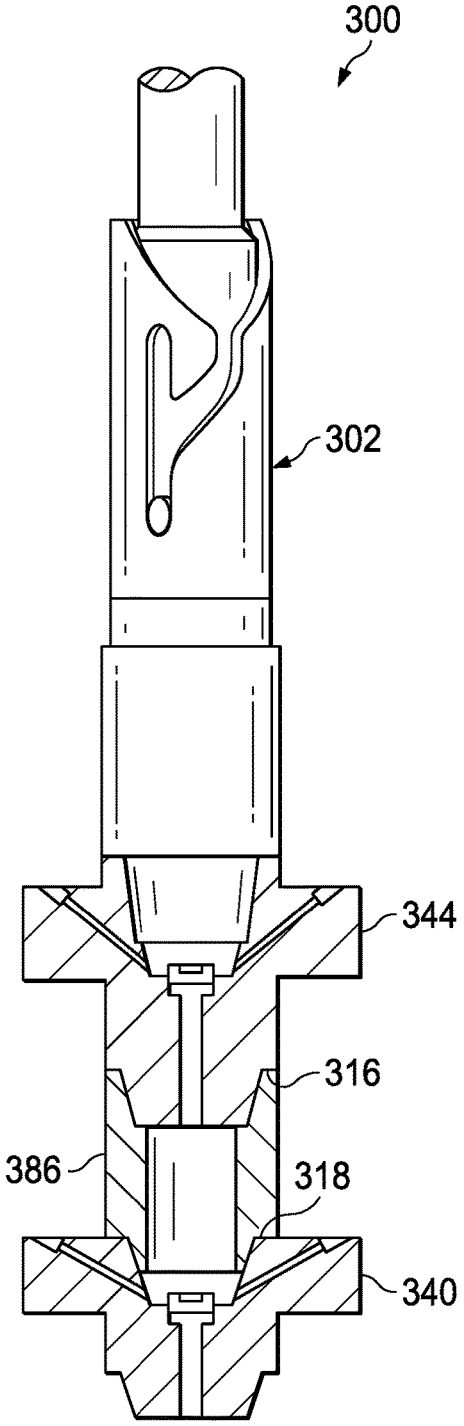
FIG. 3B is a schematic view of isolation packers of FIG. 1 installed J-slot running tool.

Referring to FIGS. 3A and 3B, a wellhead sealing assembly 300 can isolate the wellbore 104 at the wellhead during production operations. A J-slot running tool 302 can be coupled to the second packer 344, as shown in FIG. 3B, to place the wellhead sealing assembly 300 in the wellhead. The J-slot running tool 302 is a common J shaped profile tool used to place downhole tools and assemblies in tubulars. Referring to FIG. 3A, the J-slot running tool 302 includes an inner mandrel 304 with a setting pin 306. The inner mandrel 304 is optionally coupled to the drill string 308 or a workover tubular. Axial and rotational movement to place the J-slot running tool 302 in the wellbore 104 is controlled by a drilling rig (not shown). The J-slot running tool 302 includes an outer sleeve 310 with a J-shaped void 312 extending from a top surface 314 of the outer sleeve 310. The J-shaped void is configured to accept the setting pin 306 and optionally lock the inner mandrel 304 to the outer sleeve 310. The outer sleeve 310 is coupled to the downhole tool to be placed in the wellbore 104. In this implementation, the downhole tool is the wellhead sealing assembly 300. The wellhead sealing assembly 300 includes a second packer 344 coupled to the outer sleeve 302 of J-slot running tool 302. A packer spacer housing 386 is coupled to the second packer 334 by a first mechanical connector 316 to space the second pacer 344 from the first packer 340. The first packer 340 is coupled to the packer spacer housing 386 by a second mechanical connector 318. The first mechanical connector 316 and the second mechanical connector 318 are substantially similar to the mechanical connectors discussed earlier.

Figure 4:
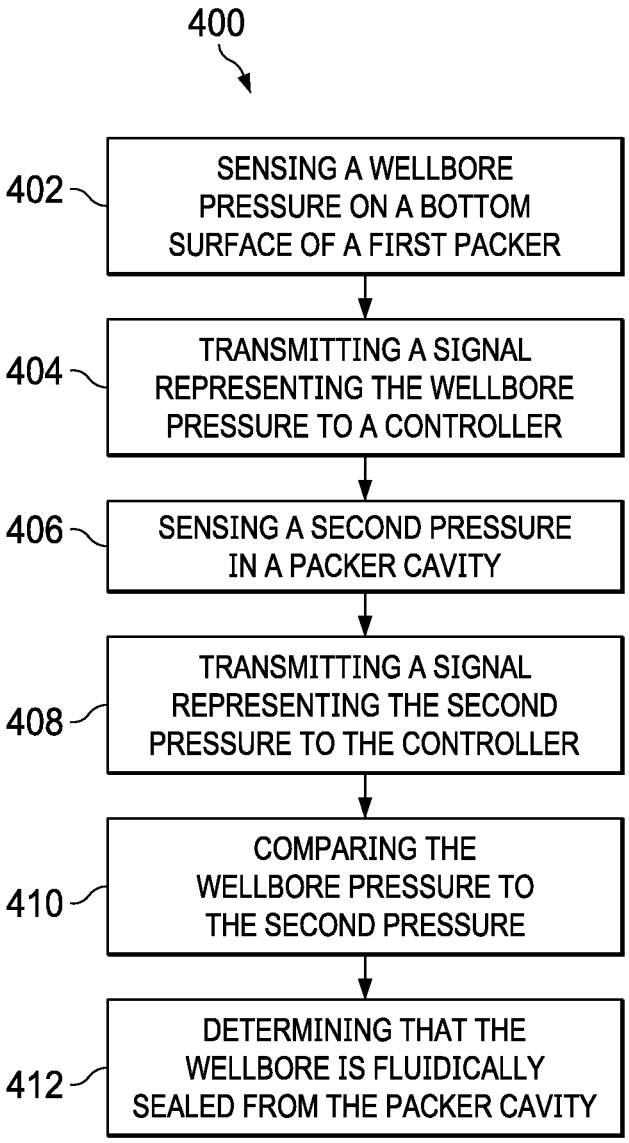
FIG. 4 is a flow chart of an example method of isolating a wellbore using a wellhead pressure isolation system according to the implementations of the present disclosure.

FIG. 4 is a flow chart of an example method 400 of isolating a wellbore with a wellbore isolation system according to the implementations of the present disclosure. At 402, a wellbore pressure on a bottom surface of a first packer is sensed. The first packer is disposed in a wellhead and configured to provide a first sealing boundary to seal the wellbore. For example, the first packer providing a first sealing boundary can include a location sensor sensing a first packer seated condition. The first packer seated condition occurs when the first packer is engaged to a first location configured to seal the wellbore. The location sensor can transmit a signal representing the first packer seated condition to the controller. For example, responsive to the controller receiving the first packer seated condition, a first packer locked condition is sensed. The first packer locked condition occurs when the first packer is locked in the first location by a lockdown device. The lockdown device transmits a signal representing the first packer locked condition to the controller. At 404, a signal representing the wellbore pressure is transmitted to a controller. At 406, a second pressure in a packer cavity is sensed. The packer cavity is defined by a top surface of the first packer, a bottom surface of a second packer disposed in the wellhead and configured provide a second sealing boundary to seal the wellhead, and the wellhead. For example, the second packer providing a second sealing boundary can include a location sensor sensing a second packer seated condition. The second packer seated condition occurs when the second packer is engaged to a second location configured to seal the first packer from an atmosphere of the Earth. The location sensor can transmit a signal representing the second packer seated condition to the controller. For example, responsive to the controller receiving the second packer seated condition, a second packer locked condition is sensed. The second packer locked condition occurs when the second packer is locked in the second location by the lockdown device. The lockdown device transmits a signal representing the second packer locked condition to the controller. At 408, a signal representing the second pressure is transmitted to the controller. At 410, the wellbore pressure is compared to the second pressure. At 412, it is determined whether the wellbore is fluidically sealed from the packer cavity. For example, the wellbore can sealed from packer cavity when the second pressure is less than the wellbore pressure. For example, the wellbore can be sealed from the packer cavity when a difference between the wellbore pressure and the second pressure is greater than or equal to a target pressure difference. For example, the wellbore pressure and the second pressure can be monitored for a time period. For example, the wellbore can be fluidically sealed from the packer cavity when the difference between the wellbore pressure and the second pressure is greater than or equal to the target pressure difference for the time period. For example, the controller receives the first packer seated condition and the second packer seated condition to determine that the first packer and the second packer are positioned to fluidically seal the wellbore. For example, the controller receives the first packer locked condition and the second packer locked condition to determine that the first packer is locked in the first location and the second packer is locked in the second location to fluidically seal the wellbore.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents

The invention claimed is:

1. A wellbore pressure isolation system comprising:

a body configured to couple to a wellbore casing assembly at a wellhead of a wellbore;

a first packer coupled to the body, the first packer configured to be disposed inside the wellhead, the first packer configured to fluidically seal the wellbore providing a first sealing boundary, the first sealing boundary configured to prevent a pressurized fluid from crossing from a first side of the first sealing boundary to a second side of the first sealing boundary;

a second packer coupled to the body, the second packer configured to be disposed in the wellhead at an uphole location relative to the first packer, the second packer configured to fluidically seal the first packer from an atmosphere of the Earth providing a second sealing boundary, the second sealing boundary configured to prevent a second pressurized fluid from crossing from a first side of the second sealing boundary to a second side of the second sealing boundary, wherein the first packer and the second packer are spatially arranged within the body to define a packer cavity, wherein the first packer and the second packer are coupled to a drill string and configured to isolate the wellbore during drilling operations; and a control assembly coupled to the body, the first packer and the second packer, the control assembly configured to:

sense a wellbore pressure on a bottom surface of the first packer, sense a second pressure in the packer cavity, and compare the wellbore pressure to the second pressure to determine that the wellbore is fluidically sealed from the packer cavity.

2. The system of claim 1, wherein the body further comprises:

an upper section configured to accept a blowout preventer assembly;

a middle section coupled to the upper section, the middle section configured to accommodate the first packer and the second packer, the first packer positioned below the second packer, wherein below the second packer is toward the wellbore; and a lower section coupled to the middle section, the lower section configured to couple to a wellbore casing at a surface of the Earth.

3. The system of claim 2, wherein the first packer and the second packer are configured to receive a locking device from the middle section of the body, where in the locking device is configured to secure the first packer and the second packer to the body.

4. The system of claim 3, wherein the locking device is a plurality of lockdown screws.

5. The system of claim 2, wherein the middle section further comprises:

a first location sensor disposed within the body and coupled to the first packer, the first location sensor configured to sense a first packer location;

a second location sensor disposed within the body and coupled to the second packer, the second location sensor configured to sense a second packer location;

wherein the first location sensor and the second location sensor are configured to sense the first packer location and the second packer location and transmit a signal representing the sensed first packer location and the second packer location to the control assembly; and wherein the control assembly receives the signal representing the sensed first packer location and the signal representing the sensed second packer location to determine that the first packer and the second packer are placed to fluidically seal the wellbore from the packer cavity.

6. The system of claim 1, further comprising a packer spacer housing configured to mechanically couple the first packer to the second packer, the second packer offset from the first packer.

7. The system of claim 1, wherein the control assembly further comprises:

a controller;

a first pressure sensor configured to sense the wellbore pressure on the bottom surface of the first packer and transmit signals representing the wellbore pressure to the controller;

a second pressure sensor configured to sense the second pressure in the packer cavity and transmit signals representing the second pressure to the controller; and wherein the controller compares the wellbore pressure to the second pressure to determine that the wellbore is fluidically sealed from the packer cavity.

8. The system of claim 1, wherein the first packer and the second packer are disposed in the wellhead with a J-slot running tool configured to couple with the first packer and the second packer to place the first packer and the second packer in the body.

9. A wellhead sealing assembly comprising:

a first packer configured to be disposed in a wellhead, wherein the first packer fluidically seals a wellbore providing a first sealing boundary, the first sealing boundary configured to prevent a pressurized fluid from crossing from a first side of the first sealing boundary to a second side of the first sealing boundary;

a second packer configured to be disposed in a wellhead, wherein the second packer fluidically seals the first packer from an atmosphere of the Earth, providing a second sealing boundary, the second sealing boundary configured to prevent a second pressurized fluid from crossing from a first side of the second sealing boundary to a second side of the second sealing boundary;

a packer spacer housing configured to mechanically couple the first packer to the second packer, the second packer offset from the first packer; and a control assembly coupled to the first packer and the second packer, the control assembly configured to:

sense a first pressure on a bottom surface of the first packer, wherein the first pressure is a wellbore pressure, sense a second pressure in a packer cavity defined by the first packer, the second packer, the packer spacer housing, and the wellhead, compare the wellbore pressure to the second pressure to determine that the wellbore is fluidically sealed from the packer cavity, wherein the wellbore is sealed from the packer cavity when a difference between the wellbore pressure and the second pressure is greater than or equal to a target pressure difference, sense a third pressure on a top surface of the second packer, wherein the third pressure is an atmospheric pressure of the Earth, transmit a signal representing the third pressure to the control assembly, compare the second pressure to the third pressure, determine that the packer cavity is fluidically sealed from the top surface of the second packer, monitor the wellbore pressure and the second pressure for a time period, and determine that the wellbore is fluidically sealed from the packer cavity when the difference between the wellbore pressure and the second pressure is greater than or equal to the target pressure difference for the time period.

10. The assembly of claim 9, further comprising:

a first pressure sensor disposed in the first packer, the first pressure sensor configured to sense the wellbore pressure on a bottom surface of the first packer and transmit signals representing the wellbore pressure to the control assembly; and a second pressure sensor disposed in the second packer, the second pressure sensor configured to sense the second pressure in the packer cavity and transmit signals representing the second pressure to the control assembly.

11. The assembly of claim 10, wherein the control assembly further comprises a controller, the controller configured to:

receive signals representing the wellbore pressure, receive signals representing the second pressure, and compare the wellbore pressure to the second pressure to determine that the wellbore is fluidically sealed from the packer cavity.

12. The assembly of claim 11, wherein the controller is further configured to:

receive a signal from a first location sensor disposed in the first packer, the first location sensor configured to sense a first packer location;

receive a signal from a second location sensor disposed in the second packer, the second location sensor configured to sense a second packer location; and determine that the first packer and the second packer are placed to fluidically seal the wellbore from the packer cavity.

13. The assembly of claim 9, wherein the first packer and the second packer are configured to receive a locking device from the wellhead, wherein the locking device is configured to secure the first packer and the second packer to the wellhead.

14. A method for isolating a wellbore comprising:

sensing a wellbore pressure on a bottom surface of a first packer, the first packer disposed in a wellhead and configured to provide a first sealing boundary to seal the wellbore, the first sealing boundary configured to prevent a pressurized fluid from crossing from a first side of the first sealing boundary to a second side of the first sealing boundary;

transmitting a signal representing the wellbore pressure to a controller;

sensing a second pressure in a packer cavity, the packer cavity defined by a top surface of the first packer, a bottom surface of a second packer disposed in the wellhead and configured provide a second sealing boundary to seal the wellhead, the second sealing boundary configured to prevent a second pressurized fluid from crossing from a first side of the second sealing boundary to a second side of the second sealing boundary;

transmitting a signal representing the second pressure to the controller;

comparing the wellbore pressure to the second pressure;

determining that the wellbore is fluidically sealed from the packer cavity, wherein the wellbore is fluidically sealed from the packer cavity when a difference between the wellbore pressure and the second pressure is greater than or equal to a target pressure difference;

sensing a third pressure on a top surface of the second packer, wherein the third pressure is an atmospheric pressure of the Earth;

transmitting a signal representing the third pressure to the controller;

comparing the second pressure to the third pressure;

determining that the packer cavity is fluidically sealed from the top surface of the second packer;

monitoring the wellbore pressure and the second pressure for a time period; and determining that the wellbore is fluidically sealed from the packer cavity when the difference between the wellbore pressure and the second pressure is greater than or equal to the target pressure difference for the time period.

15. The method of claim 14, wherein the wellbore is sealed from packer cavity when the second pressure is less than the wellbore pressure.

16. The method of claim 14, further comprising:

sensing a first packer seated condition, wherein the first packer seated condition occurs when the first packer is engaged in a first location configured to seal the wellbore;

transmitting a signal representing the first packer seated condition to the controller;

sensing a second packer seated condition, wherein the second packer seated condition occurs when the second packer is engaged to a second location configured to seal the first packer from an atmosphere of the Earth;

transmitting a signal representing the second packer seated condition to the controller; and determining that the first packer and the second packer are positioned to fluidically seal the wellbore when the first packer seated condition and the second packer seated condition is received by the controller.

17. The method of claim 16, further comprising:

responsive to determining that the first packer and the second packer are positioned to fluidically seal the wellbore by the first packer seated condition and the second packer seated condition;

sensing a first packer locked condition, wherein the first packer locked condition occurs when the first packer is locked in the first location by a lockdown device;

transmitting a signal representing the first packer locked condition to the controller; sensing a second packer locked condition, wherein the second packer locked condition occurs when the second packer is locked in the second location by a lockdown device;

transmitting a signal representing the second packer locked condition to the controller; and determining that the first packer is locked in the first location and the second packer is locked in the second location to fluidically seal the wellbore when the first packer locked condition and the second packer locked condition is received by the controller.

* * * * *